US010851527B2

(12) United States Patent
Baur et al.

(10) Patent No.: US 10,851,527 B2
(45) Date of Patent: Dec. 1, 2020

(54) PULL-OUT HOSE DEVICE HAVING A FLUID CONNECTOR AND SANITARY SHOWER

(71) Applicant: Hansgrohe SE, Schiltach (DE)

(72) Inventors: Daniel Baur, Villingendorf (DE); Günther Lehmann, Oberwolfach (DE)

(73) Assignee: Hansgrohe SE, Schiltach (DE)

( * ) Notice: Subject to any disclaimer, the term of this patent is extended or adjusted under 35 U.S.C. 154(b) by 79 days.

(21) Appl. No.: 16/250,969

(22) Filed: Jan. 17, 2019

(65) Prior Publication Data

US 2019/0218756 A1 Jul. 18, 2019

(30) Foreign Application Priority Data

Jan. 18, 2018 (DE) ..... 10 2018 200 824

(51) Int. Cl.
*E03C 1/06* (2006.01)
*E03C 1/04* (2006.01)

(52) U.S. Cl.
CPC ..... *E03C 1/06* (2013.01); *E03C 2001/0415* (2013.01)

(58) Field of Classification Search
CPC ..... E03C 1/06; E03C 1/066; E03C 2001/0415
See application file for complete search history.

(56) References Cited

U.S. PATENT DOCUMENTS 3,737,107 A 6/1973 Wright
6,381,770 B1 * 5/2002 Raisch ..... E03C 1/0404 4/567

(Continued)

FOREIGN PATENT DOCUMENTS

AT 193320 11/1957
CN 104257311 A 1/2015

(Continued)

OTHER PUBLICATIONS

Search Report and Decision to Grant in Russian language with English translation issued by the Federal Service for Intellectual Property, Patents and Trademarks (ROSPATENT), dated Sep. 9, 2019, for Russian Patent Application No. 22019100519/10(000779).

(Continued)

*Primary Examiner* — Kevin F Murphy
(74) *Attorney, Agent, or Firm* — Faegre Drinker Biddle & Reath LLP

(57) ABSTRACT

A pull-out hose device includes a hose box with a box housing, a pull-out hose held on the box housing to be pulled out and having at least one hose bend accommodated in the box housing, and a fluid connector for the pull-out hose. According to an illustrative embodiment, the hose box has a box holding frame to which the box housing is removably attachable in a mounting direction and is detachable therefrom in a demounting direction. The fluid connector includes a first connector part disposed on the box housing, to which connector part the pull-out hose is connected with one hose end, and a second connector part disposed on the box holding frame. The first and the second connector parts are connectable to each other in a fluid-tight manner in the mounting direction and are disconnectable from each other in the demounting direction.

12 Claims, 6 Drawing Sheets

(56) References Cited

U.S. PATENT DOCUMENTS

| | | | | |
|---|---|---|---|---|
| 7,325,260 | B1 * | 2/2008 | Hoyt | E03C 1/06 4/567 |
| 7,337,808 | B2 | 3/2008 | Shamir et al. | |
| 9,840,831 | B1 * | 12/2017 | Esche | E03C 1/0404 |
| 2005/0132488 | A1 * | 6/2005 | Biondo | A61H 33/0087 4/541.1 |
| 2008/0185456 | A1 * | 8/2008 | McCabe | E03C 1/06 239/197 |
| 2012/0151669 | A1 | 6/2012 | Wilson | |
| 2016/0177552 | A1 | 6/2016 | Wilson | |
| 2016/0237661 | A1 | 8/2016 | Teagarden | |
| 2017/0233988 | A1 | 8/2017 | Wilson | |
| 2018/0347160 | A1 | 12/2018 | Wilson | |
| 2020/0018051 | A1 | 1/2020 | Wilson | |

FOREIGN PATENT DOCUMENTS

| | | | |
|---|---|---|---|
| DE | 3634738 | C1 | 4/1988 |
| DE | 3901007 | A1 | 7/1989 |
| DE | 20113857 | U1 | 1/2002 |
| DE | 202005019492 | U1 | 2/2006 |
| DE | 102015226412 | A1 | 6/2017 |
| DE | 102017200327 | B3 | 5/2018 |
| EP | 2009188 | A2 | 12/2008 |
| RU | 2319888 | C2 | 3/2008 |

OTHER PUBLICATIONS

English translation and in Chinese language of First Office Action issued by the National Intellectual Property Administration, P.R. China, dated Apr. 1, 2020, for Chinese Patent Application No. 201910048831.9; 12 pages.

* cited by examiner

PULL-OUT HOSE DEVICE HAVING A FLUID CONNECTOR AND SANITARY SHOWER

CROSS-REFERENCE TO RELATED APPLICATION

This application claims priority to German Patent Application No. DE 10 2018 200 824.8, filed on Jan. 18, 2018, the disclosure of which is expressly incorporated herein by reference.

BACKGROUND AND SUMMARY OF THE DISCLOSURE

The invention relates to a pull-out hose device, which comprises a hose box with a box housing, a pull-out hose held on the box housing to enable it to be pulled out and having at least one hose loop accommodated in the box housing, and a fluid connector for the pull-out hose, as well as to a sanitary shower equipped with a pull-out hose device of this kind. In this context, "pull-out hose" refers to a hose which, at one end, can be pulled out of the hose box and moved back into same, wherein a user element, which can perform a desired useful function with the fluid supplied, e.g. a shower function, is typically disposed on this end of the hose.

Hose pull-out devices of this kind are known in many embodiments and are used, for example, in sanitary showers that have a pull-out shower head unit, e.g. extendable shower units for kitchens and hand-held showers for bathtubs. The box housing of the hose box serves to accommodate the hose loop or loops, preferably in a manner secure against twisting, and optionally to guide said hose loop or loops when the hose loop or loops hang down in a U shape with a length that varies depending on the pull-out state of the hose. A guide weight roller optionally inserted in a rotatable manner into the hose loop can perform or assist the guidance of the hose loop as an alternative or in addition to the box housing.

A pull-out hose device of this kind is disclosed in Laid-Open Publication DE 10 2015 226 412 A1, for example. In an application shown there for an extendable shower unit for kitchens, the pull-out hose is coupled on the outlet side to a shower head unit and on the inlet side to an outlet of a corresponding kitchen sink fitting, e.g. a single-lever mixer. The box housing is arranged in a sink bottom section and mounted on a corresponding bottom section wall.

Utility Model Publication DE 20 2005 019 492 U1 discloses a sanitary shower having another pull-out hose device of this kind, wherein, in this case, a pull-out shower hose is connected at the fluid-inlet end thereof by means of a threaded coupling to a channel drilled in the box housing, which, for its part, is connected by means of a corresponding connection coupling to an inlet of the box housing for connection to a water supply. As an alternative, the shower hose is passed on the inlet side through an opening in the box housing and connected by means of a threaded coupling to a water pipe connection outside the box housing.

In another pull-out hose device of this kind, which is disclosed in Patent Publication AT 193 320, the box housing is formed by a supporting part, by a casing secured on the supporting part by means of a push-fit fastening and by a top part mounted on the casing, on the upper side of which top part there is disposed a mixing valve, to the underside of which a cold water pipe, a hot water pipe and the pull-out hose are connected. The cold water pipe and the hot water pipe are routed upwards in the box housing from a respectively associated opening in the supporting part as far as the underside of the mixing valve.

In the prior German Patent Application 10 2017 200 327, another pull-out hose device of this kind is described, in which the pull-out hose has a plurality of downward-hanging hose loops, which are accommodated in the hose box in a manner secure against twisting. A guide weight roller with a rotational axis that can be moved in translation can be inserted rotatably into each of the hose loops. In an upper box region, the hose box includes at least one hose deflection element for hose deflection in each case between two of the downward-hanging hose loops, e.g. in the form of an arcuate sliding element disposed immovably on the hose box. A fluid inlet connection for the pull-out hose can be integrated into the hose box, e.g. in the form of a vertical inlet connection pipe which is disposed on the narrow side on the outside in the upper half of the box and, at its lower end, has a conventional inlet connection piece and, at the upper end, opens into the hose box and merges there, by means of a U bend, into a hose connector, to which the inlet end of the pull-out hose is coupled from below.

It is an object of the invention to provide a pull-out hose device of the type stated at the outset which has novel and advantageous functionalities, especially in respect of the fluid connector for the pull-out hose, as compared with the above mentioned prior art, and of providing a sanitary shower equipped there with.

The invention achieves this and other objects by providing an inventive pull-out hose device and by providing a sanitary shower equipped with such inventive pull-out hose device.

An illustrative pull-out hose device includes a hose box containing a box holding frame and a box housing which is removably attachable in a mounting direction and from which the box housing is detachable in a demounting direction. A fluid connector is provided which includes a first connector part disposed on the box housing, and a second connector part disposed on the box holding frame, wherein the pull-out hose is connected with one hose end to the first connector part. The first and the second connector parts are connectable to each other in a fluid-tight manner in the mounting direction and are disconnectable from each other in the demounting direction.

These characteristics make it possible, in the pull-out hose device according to the invention, to remove the box housing with the pull-out hose from the box holding frame and, by means of this demounting movement, simultaneously to disconnect the fluid connector for the pull-out hose since, to detach or separate the fluid connector, the first and the second connector parts can be detached or separated from one another in the same direction as the direction in which the box housing can be removed from the box holding frame, namely in said demounting direction. As a result, it is not necessary to detach the fluid connector for the pull-out hose first before the box housing is removed from the box holding frame. Both functions can take place simultaneously with the same handling movement, i.e. it is possible, by removing the box housing from the box holding frame, simultaneously to detach or separate the fluid connector for the pull-out hose. In the same way, the fluid connector can be re-created, i.e. the two connector parts can be connected to each other again, simultaneously with remounting of the box housing on the box frame, with the same handling movement.

The box holding frame can advantageously be used to mount the hose box at a desired location of use, e.g. in the case of a pull-out hose device for an extendable hand-held shower for a bathtub, by attaching the box holding frame to a bathtub panel or to an adjoining wall region of a bathroom. Since the box housing is removably attached to the box holding frame, it can be removed from the latter for maintenance purposes, for example, without the box holding frame itself having to be demounted for this purpose or having to release the fastening thereof, e.g. to a bathtub panel, a kitchen sink bottom section or the like. As an alternative, the box holding frame can also be formed by part of a shower or bathroom wall region, a bathtub panel or a kitchen sink bottom section.

In a development of the invention, the first connector part has a first connector piece and the second connector part has a second connector piece, wherein the two connector pieces can be inserted one into the other, i.e. one connector piece can be inserted into the other connector piece. The second connector piece extends into the interior of the box housing through an opening in the box housing in parallel to the mounting direction. This has the advantage that fluid which escapes in the event of a leak in the fluid connector can be held in the box housing and does not cause any leak outside the box housing. The reason is that, since the second connector piece extends into the interior of the box housing, the joint at risk from leakage between the two connector pieces is situated within the box housing. Since the second connector piece extends into the interior of the box housing through the opening in the latter parallel to the mounting direction, the insertion of the two connector pieces one into the other to create the fluid connector when the box housing is mounted on the box holding frame can be accomplished by this mounting of the box housing on the box holding frame in the mounting direction.

In corresponding developments of the invention, the mounting direction is a translational direction or a rotational direction or a pivoting direction, wherein the demounting direction is in each case opposite to the mounting direction. In the case of the translational direction, the box housing is mounted on the holding frame by means of a translational movement, e.g. from above, from below or from the side. In corresponding fashion, the first and the second connector parts of the fluid connector can then also be connected to one another in a fluid-tight manner or detached from one another by means of this translational movement of the box housing relative to the box holding frame. In the case of the direction of rotation, the box housing can be attached to the box holding frame or removed again therefrom by means of a rotary motion, and, accordingly, the two connector parts of the fluid connector can be connected to each other fluid-tightly and released from each other again by means of this rotary motion. In the case of the pivoting direction, the box housing is attached to the box holding frame or removed again therefrom by means of a pivoting motion, and, in corresponding fashion, the two connector parts of the fluid connector can be connected to each other fluid-tightly and released from each other again by means of this pivoting motion.

In a development of the invention, the box housing is open on a top side and is fluid-tight at least in a lower region, and, in an installed position of the hose box, the mounting direction extends vertically. By virtue of the fluid-tight embodiment, at least of its lower region, the box housing is suitable as a leaked-fluid collector if fluid escapes in the region of the box housing in the event of a leak, e.g. in the pull-out hose or the connectors located at the ends thereof. The open top side of the box housing can be used, for example, to pull the fluid-outlet-side hose section of the pull-out hose out of the box housing there, i.e. to pull it upwards out of the box. The vertical mounting direction in the installed position of the hose box makes it possible, for example, to attach the hose box to the box holding frame from above or from below. In this development, the removal of the box housing from the box holding frame can also be used to empty the box housing of any leaked fluid that has collected, without the need for this purpose of demounting the box holding frame and without the requirement for an additional handling step to release the pull-out hose from a fluid supply connector.

In a development of the invention, the at least one hose loop is accommodated in the box housing hanging downwards in variable length in a U shape. The box housing is curved in a U shape on its bottom side and/or has a vertical length that is greater than its horizontal width. This combines an advantageous, gravity-assisted orientation of the hose loop or loops with an advantageous configuration or dimensioning of the box housing.

In a development of the invention, the box housing has a horizontal depth that is less than its horizontal width, and the fluid connector is disposed in a narrow side region of the hose box. This represents an advantageous implementation of the box housing in combination with the fluid connector, wherein, when required, this combination supports a compact construction and, in particular, a relatively small overall depth of the pull-out hose device.

In a development of the invention, the fluid connector is disposed in a top side region of the hose box. This is advantageous for particular applications, for example also in respect of the accessibility of the fluid connector and especially of the second connector part thereof, which is disposed on the box holding frame.

In a development of the invention, the fluid connector includes a non-return valve to safeguard counter to the direction facing the pull-out hose and/or the second connector part includes a non-return valve to safeguard in the direction of the pull-out hose. The first alternative has the advantage that a return flow of fluid from the pull-out hose into the second connector part can be prevented by a non-return valve of this kind. In the case of use in a shower unit, it is thereby possible, for example, to prevent dirty water from being drawn in via the shower and entering the second connector part via the pull-out hose and, from there, passing on, for example, into an associated upstream pipe system or the like. The last-mentioned non-return valve has the advantage that accidental emergence of fluid from the second connector part can be reliably avoided when the first connector part is released from the second connector part to separate the fluid connector and there is possibly still fluid pressure in a fluid feed line to the second connector part. To achieve this, it is expedient if this non-return valve is positively opened in a self-acting way by the coupling of the first connector part to the second connector part as the box housing is attached to the box holding frame, wherein it then closes automatically when the first connector part is decoupled from the second connector part as the box housing is removed from the box holding frame.

In a development of the invention, the fluid connector includes a safety device to safeguard the first connector part against self-acting disengagement from the second connector part. It is thereby possible in an advantageous manner to prevent accidental release of the fluid connector. The safety device can be embodied in such a way, for example, that it can be disengaged by a user in order to allow the release of the first connector part from the second connector part.

In a development of the invention, the box housing includes a mounting bracket arrangement with at least one mounting bracket that is turnable between an operating position and a rest position, which bracket includes a releasable locking mechanism, by means of which mechanism the attachment of the box housing to the box holding frame is capable to be locked, wherein the locking mechanism is released by a turning move of the mounting bracket from the rest position to the operating position and is locked by a turning move of the mounting bracket from the operating position to the rest position. The box housing can thereby be secured against simple removal from the box holding frame, and the mounting bracket or brackets can facilitate the removal of the box housing from the box holding frame in terms of handling.

The sanitary shower according to the invention is equipped with a pull-out hose device according to the invention and with a shower head unit, which has a shower outlet part and a shower handle part. The shower head unit is connected at a fluid inlet to a fluid outlet of the pull-out hose, and the hose box includes a holder for detachably holding the shower head unit. Through the use of the pull-out hose device according to the invention, the sanitary shower has the properties and advantages mentioned for this pull-out hose device. Moreover, the hose box serves as a holder for the shower head unit. This holder is preferably located on the box housing of the hose box. In this case, the box housing can be removed from the box holding frame together with the pull-out hose and the shower head unit.

BRIEF DESCRIPTION OF THE DRAWINGS

Advantageous embodiments of the invention are illustrated in the drawings. These and further embodiments of the invention are described in greater detail below. In the drawings.

DETAILED DESCRIPTION OF THE DRAWINGS

Figure 1:
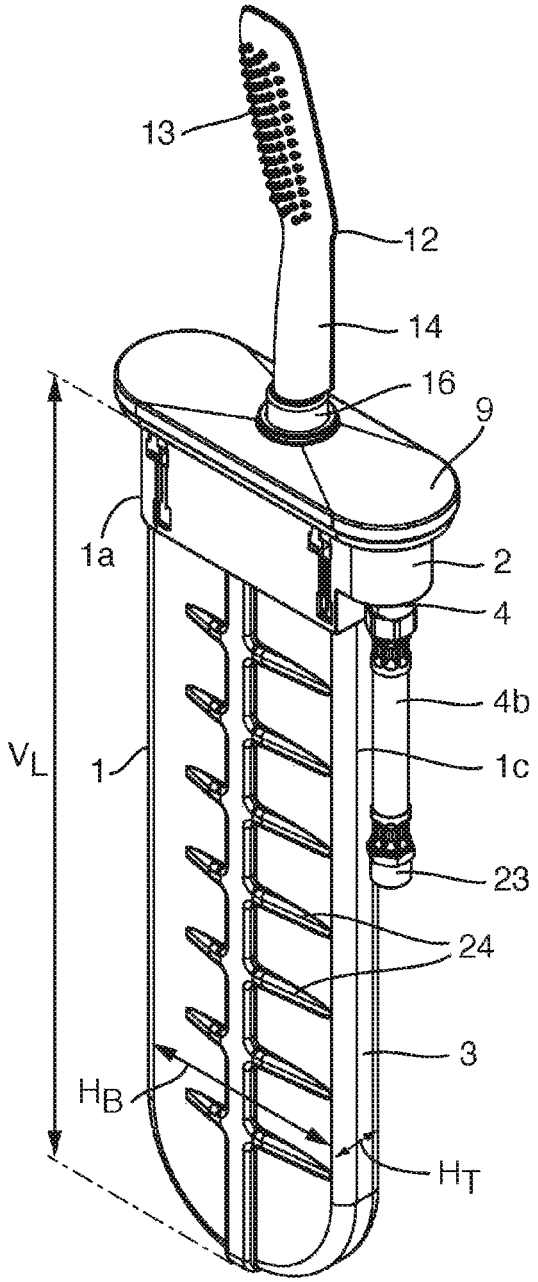
FIG. 1 shows a perspective view of a shower having a pull-out hose device.

The shower illustrated in the figures has a pull-out hose device, which comprises a hose box 1 having a box holding frame 2 and a box housing 3, which is removably attachable on the box holding frame 2 in a mounting direction M and is removable from the box holding frame 2 in a demounting direction D. A pull-out hose 5 is held on the box housing 3 in a manner which enables it to be pulled out. The pull-out hose 5 comprises at least one hose loop 5*a* accommodated in the box housing 3. In the illustrative embodiment shown, the pull-out hose 5 comprises two hose loops 5*a*, 5*b* accommodated in the box housing 3; in alternative embodiments, it comprises just one or three or more hose loops, which are accommodated in the box housing 3.

The pull-out hose device comprises a fluid connector 4 for the pull-out hose 5, wherein the fluid connector 4 has a first connector part 4*a* disposed on the box housing 3 and a second connector part 4*b* disposed on the box holding frame 2. The pull-out hose 5 is connected by a hose end 6 to the first connector part 4*a*. The first and the second connector parts 4*a*, 4*b* are connectable to each other in a fluid-tight manner in the mounting direction M and are disconnectable from each other in the demounting direction D. As already mentioned above, it is thereby possible to detach or separate the fluid connector 4 for the pull-out hose 5 simultaneously with the removal of the box housing 3 from the box holding frame 2 and to re-create the fluid connector 4 simultaneously with the reattachment of the box housing 3 to the box holding frame 2. Any connecting means of the kind known per se to a person skilled in the art for establishing such fluid connections can be used for the detachable connection of the two connector parts 4*a*, 4*b*, including plug connection means, screw connection means and combinations thereof.

In the illustrative embodiment shown, the mounting direction M is a translational direction. In alternative embodiments, the mounting direction is a rotational direction or a pivoting direction. In the illustrative embodiment shown, the demounting direction D is counter to the mounting direction M. In alternative embodiments, this is not the case, it being possible, for example, for the demounting direction to be oblique relative to the mounting direction, or for the mounting direction to be a translational direction and the demounting direction to be a rotational direction or pivoting direction, or for the mounting direction to be a rotational direction or pivoting direction and the demounting direction to be a translational direction. In the illustrative embodiment shown, the mounting direction M and the demounting direction D are parallel to a longitudinal axis L of the pull-out hose device while, in alternative embodiments, this is not the case, it being possible, for example, in such embodiments for the mounting direction and/or the demounting direction to be oblique or perpendicular to the longitudinal axis of the pull-out hose device. In the example shown, the pull-out hose device is configured for vertical mounting and demounting, i.e. the mounting direction M and the demounting direction D each extend in a vertical direction, e.g. the mounting direction M extends downwards and the demounting direction D extends upwards. In alternative embodiments, this is not the case, it being possible, for example, in such embodiments for the mounting direction and/or the demounting direction to be horizontal or oblique relative to the horizontal.

In corresponding embodiments, the first connector part 4*a* has a first connector piece 7*a* and the second connector part 4*b* has a second connector piece 7*b*, wherein the two connector pieces 7*a*, 7*b* are insertable into each other, and the second connector piece 7*b* extends into the interior of the box housing 3 through an opening 8 of the box housing 3 in parallel to the mounting direction M, as is the case in the illustrative embodiment shown. It is thereby possible to ensure that the connecting or separating point between the two connector pieces 4*a*, 4*b* is in the box housing 3 and not outside the box housing 3. This has the advantage that any leaking fluid which accidentally escapes at this connecting or separating point in the event of a leak can be held and collected in the box housing 3, thus ensuring that it does not get into the external area outside the box housing 3.

In corresponding embodiments, a lower inlet connector piece 23 of the second connector part 4*b* is used for connection to a fluid or water supply, this connection being conventional and therefore not shown specifically. In this case, the fluid or water emerges from the pull-out hose 5 at the pull-out end thereof. As an alternative, the opposite fluid flow direction can be provided, i.e. the fluid enters the pull-out hose 5 at the pull-out end thereof and emerges from the second connector part 4*b*.

In corresponding embodiments of the pull-out hose device, as in the example shown, the box housing 3 is open on a top side 3*a* and is fluid-tight at least in a lower region 3*b*, wherein, in an installed position of the hose box 1, the mounting direction M extends vertically. This enables fluid that enters the box housing 3 owing to a leak or as spray or for some other reason to be collected in the fluid-tight lower region 3*b* of the box housing 3. The open top side can be used to dispose there the pull-out end of the pull-out hose 5, i.e. to enable the pull-out hose 5 to be pulled upwards out of the hose box 1. As an option, the open top side 3*a* of the box housing 3 can be covered by a removable covering rosette 9, as in the example shown. In alternative embodiments, the pull-out hose can be pulled out of the hose box on a different side of said box, e.g. downwards or laterally. As an option, the box housing 3 can be provided with a reinforcing rib structure 24, as shown. This can enhance the stability of the box housing 3 and favour manufacture thereof with a relatively low weight.

In corresponding embodiments of the pull-out hose device, as in the example shown, the at least one hose loop 5*a* is accommodated in the box housing 3 hanging downwards in variable length in a U shape, wherein the box housing 3 is curved in a U shape on its bottom side and/or the box housing 3 has a vertical length $V_L$ that is greater than its horizontal width $H_B$. This allows a correspondingly long length for the downward-hanging hose loop or loops 5*a*, 5*b* in the box housing 3 and promotes a compact construction of the hose box 1. In alternative embodiments, the at least one hose loop is accommodated with a variable length in some other position, e.g. horizontally, in the box housing, or the box housing is not curved in a U shape on its bottom side but has a polygonal or rectangular contour, for example, or the box housing has a vertical length which is less than its horizontal width.

In corresponding embodiments of the pull-out hose device, as in the example shown, the box housing 3 has a horizontal depth $H_T$ that is less than its horizontal width $H_B$, and the fluid connector 4 is disposed in a narrow side region 3*c* of the hose box 1 or of the box housing 3. This favours accommodation of the hose loop or loops 5*a*, 5*b* in a manner secured against twisting in the box housing 3 and favours space-saving arrangement of the fluid connector 4. In alternative embodiments, the box housing has a horizontal depth that is greater than its horizontal width, and/or the fluid connector is disposed in a wide side region of the hose box.

In corresponding embodiments of the pull-out hose device, the fluid connector 4 is disposed in a top side region 1*a* of the hose box 1, as in the example shown. In corresponding applications, this can be advantageous, e.g. as regards accessibility of the fluid connector 4 and/or as regards simple coupling of the fluid connector 4 to a fluid supply. In alternative embodiments, the fluid connector is disposed in a central or lower region of the hose box.

In corresponding embodiments of the pull-out hose device, as in the example shown, the fluid connector 4 includes a non-return valve 10 to safeguard counter to the direction facing the pull-out hose 5. It is thereby possible, for example, to avoid a situation where dirty water can be drawn in at the pull-out end of the pull-out hose and can enter the second connector part 4*b* via the pull-out hose 5 and, from there, can flow rearwards into an upstream line segment. In addition or as an alternative, a non-return valve (not shown) that safeguards in the direction of the pull-out hose 5 can be provided in the second connector part 4*b*. By means of a non-return valve of this kind, it is possible to prevent fluid which is fed to the second connector part 4*b* on the inlet side from emerging from the second connector part 4*b* when the two connector parts 4*a*, 4*b* are detached from each other. To achieve this, it is expedient if this non-return valve is configured and arranged in such a way that it is positively opened as the two connector parts 4*a*, 4*b* are coupled together to create the fluid connector 4 and is then automatically closed again when the two connector parts 4*a*, 4*b* are separated. In further alternative embodiments, no non-return valve is provided.

Figure 6:
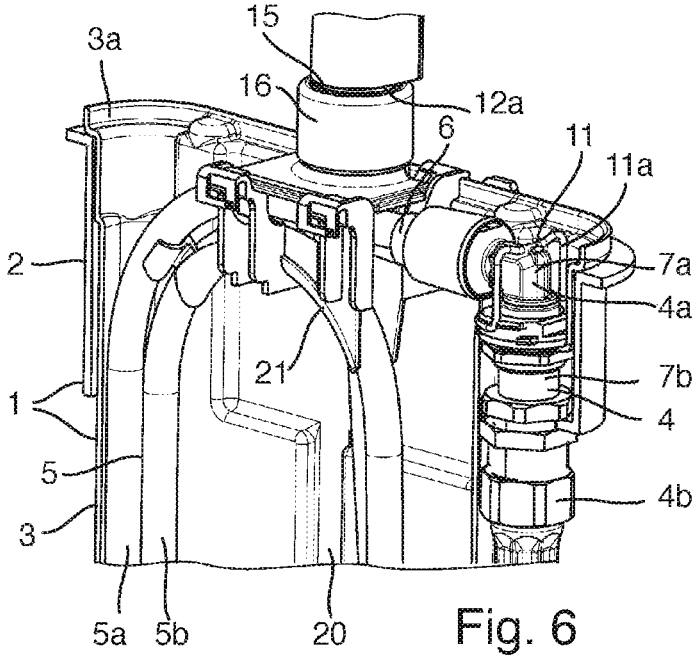
FIG. 6 shows a detail view of a segment of an upper box housing region from FIG. 3.
Figure 5:
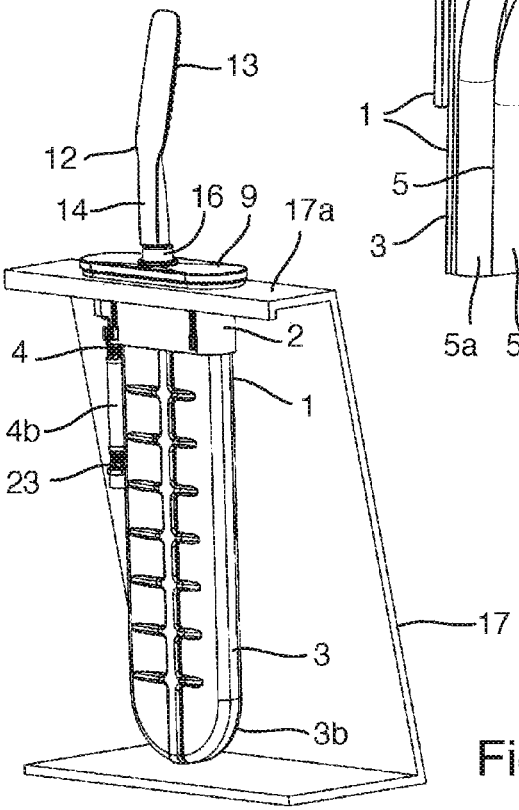
FIG. 5 shows a perspective view from the inside of the tub panel region with the shower.
Figure 7:
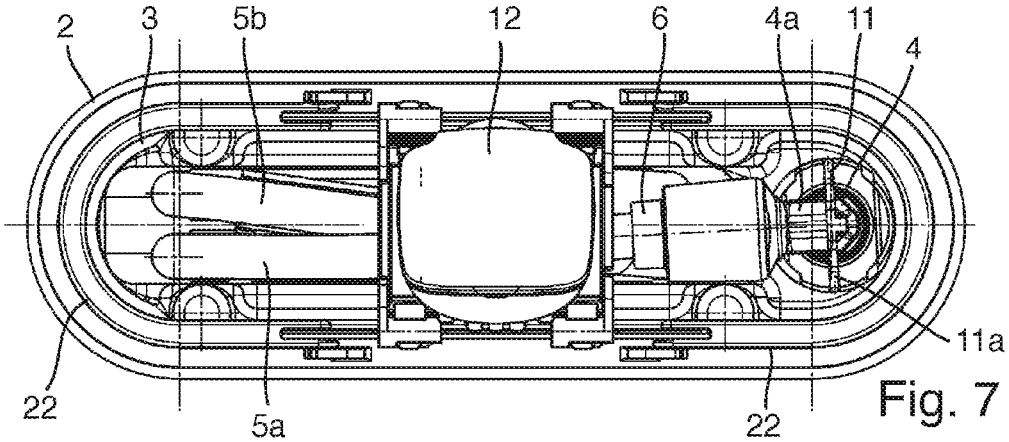
FIG. 7 shows a plan view from above of the shower according to FIG. 2.
Figure 9:
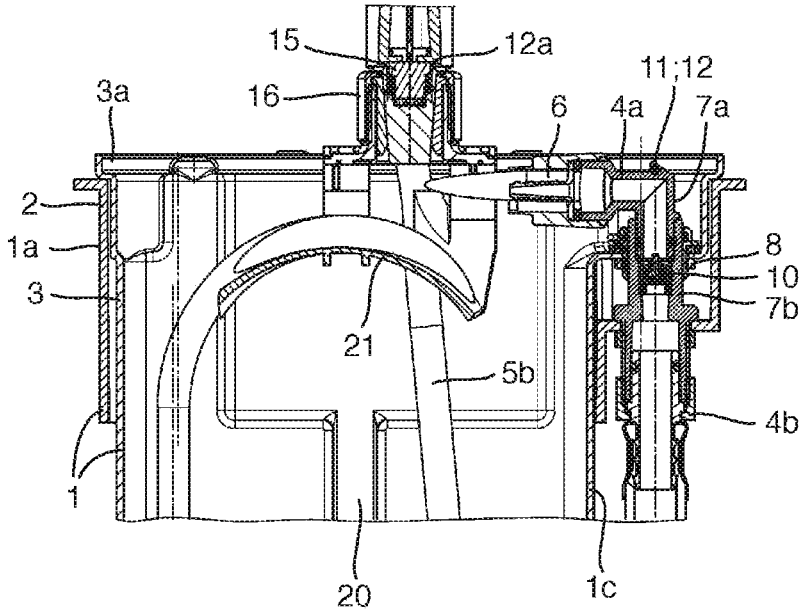
FIG. 9 shows a detail view of an upper box housing region in the longitudinal section from FIG. 8.
Figure 8:
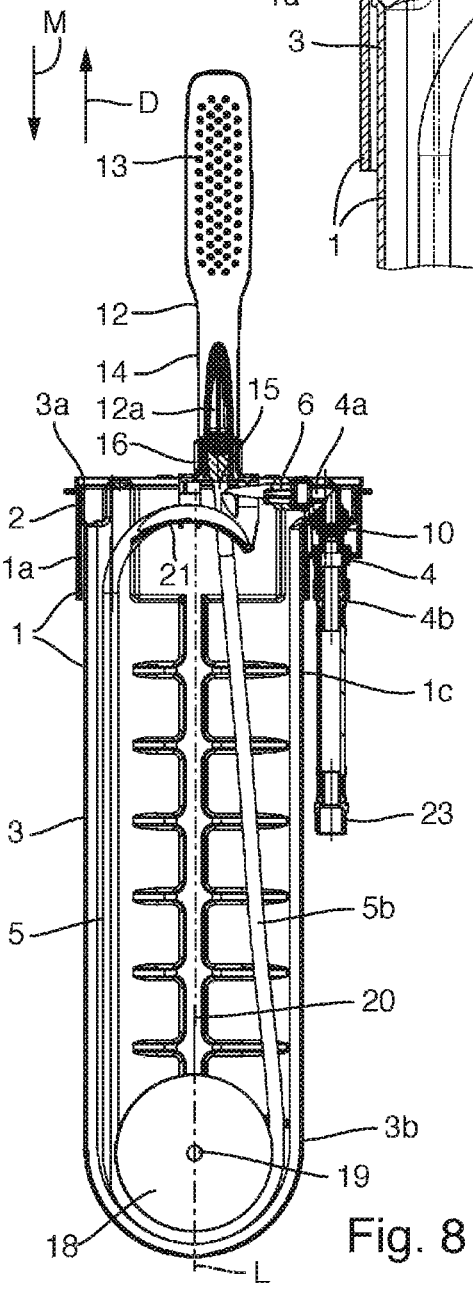
FIG. 8 shows a longitudinal section of the shower.

In corresponding embodiments, as in the example shown, the fluid connector 4 includes a safety device 11 to safeguard the first connector part 4*a* against self-acting disengagement from the second connector part 4*b*. For this purpose, it is possible to use any safety devices of the kind familiar per se to a person skilled in the art for securing two connected connector parts in this way. In the illustrative embodiment shown, the safety device 11 includes a safety bracket 11*a*, which is held detachably, e.g. by means of a snap or clip joint, on the second connector part 4*b* in a safety position visible in FIG. 6, for example, and fits around the first connector part 4*a* in the demounting direction D and thereby prevents the first connector part 4*a* from being removed from the second connector part 4*b* in the demounting direction D. To disengage this safety device, the safety bracket 11*a* can be released from the second connector part 4*b*, e.g. by unlatching the snap or clip joint mentioned, after which the first connector part 4*a* can be removed from the second connector part 4*b* in the demounting direction D. During this process, the safety bracket 11*a* can remain on the first connector part 4*a*. In alternative embodiments, the safety bracket 12 remains on the second connector part 4*b* and can be swung away or moved in some other way for disengagement in such a way that it no longer fits around the first connector part 4*a* in the demounting direction D, with the result that the first connector part 4*a* is released for detachment from the second connector part 4*b* in the demounting direction D.

As an alternative, the pull-out hose device used in the shower shown, which can be a sanitary shower, for example, can be used for any other sanitary or non-sanitary shower or for some other fluid-carrying device having a pull-out hose. In the example shown, the shower comprises the pull-out hose device and a shower head unit 12 having a shower outlet part 13 and a shower handle part 14. The shower head unit 12 has a fluid inlet 12*a*, at which it is connected to a fluid outlet 15 of the pull-out hose 5. The hose box 1 of the pull-out hose device comprises a holder 16 for detachably holding the shower head unit 12.

In the illustrative embodiment shown, the shower is suitable, for example, as a hand-held shower for a bathtub, in which the pull-out hose device can be disposed in a concealed manner, for example, on the inside of an associated bathtub panel 17, as illustrated in FIGS. 4, 5, 10 and 11. In the example shown, the pull-out hose device is held for this purpose by means of its box holding frame 2 on the bathtub panel 17, in a corresponding opening in a top side region 17*a* of the bathtub panel 17. This top side region 17*a* of the bathtub panel 17 can adjoin a bathtub rim of the bathtub at the side, for example.

The box housing 3 of the hose box 1 can be inserted into the box holding frame 2 in the mounting direction M from the top down, with its open top side 3*a* facing upwards, and removed from the bottom up from said frame in the demounting direction D, wherein the open top side 3*a* of the box housing 3 is covered with the optional covering rosette 9 in the inserted state. Accordingly, the shower head unit 12 can be pulled upwards out of the box housing 3 for use as a hand-held shower in the bathtub. After use, it can be returned to its holder 16 on the hose box 1.

This return movement can be assisted by an optional guide weight roller arrangement 18, which comprises a respective guide weight roller 18*a*, 18*b* inserted into each hose loop 5*a*, 5*b* in such a way as to be rotatable about a rotational axis 19. In particular, this can be a guide weight roller arrangement of the kind described in the prior German Patent Application 10 2017 200 327 mentioned, to which reference can be made in the present case for further details in this respect. Together with the dimensioning of the box housing 3, which is matched to the dimensions of the hose loop or loops 5*a*, 5*b*, the guide weight roller arrangement 18 assists the accommodation of the hose loops 5*a*, 5*b* in a manner secured against twisting and, by virtue of the dead weight of the guide weight rollers 18*a*, 18*b*, can additionally assist return of the pulled-out shower head unit 12 to its holder 16. The guide weight rollers 18*a*, 18*b* act as loose, vertically movable rollers, for which purpose the rotational axis 19 thereof is guided in a correspondingly vertically movable manner in a vertical guide 20 on the inside of the box housing 3. For the deflection of the hose at the top between the two hose loops 5*a*, 5*b* shown, there is an arcuate sliding element 21 disposed immovably on the hose box 1.

To remove the box housing 3 from the box holding frame 2, starting from the fully assembled state of the hose box 1, the user first of all removes the optional covering rosette 9 and, in the example shown, then pulls the box housing 3 upwards out of the box holding frame 2. In this case, the pull-out hose 5 remains in the box housing 3, and the shower head unit 12 remains in its holder 16.

Figure 2:
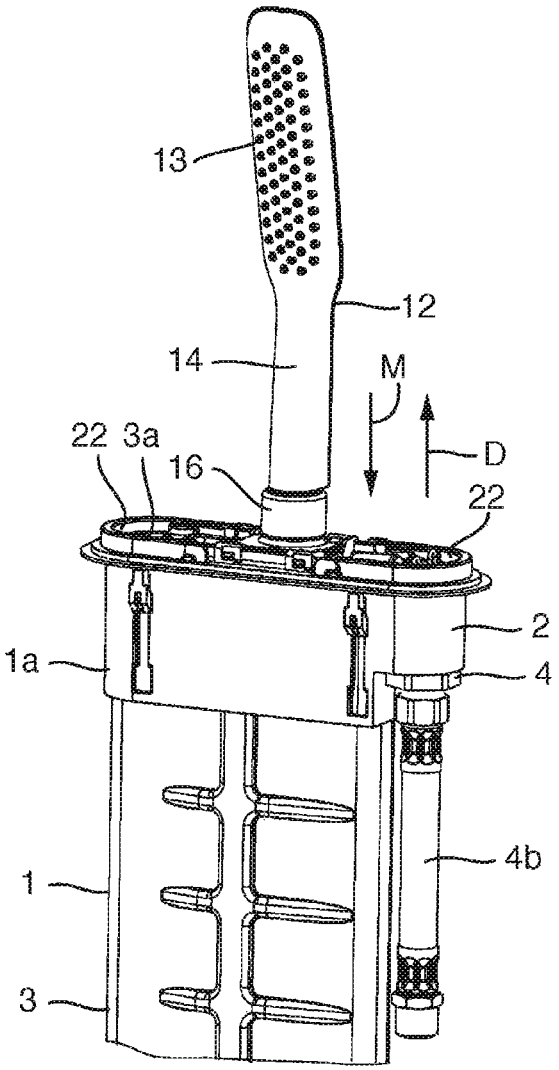
FIG. 2 shows the view from FIG. 1 in an upper region with a covering rosette removed.
Figure 3:
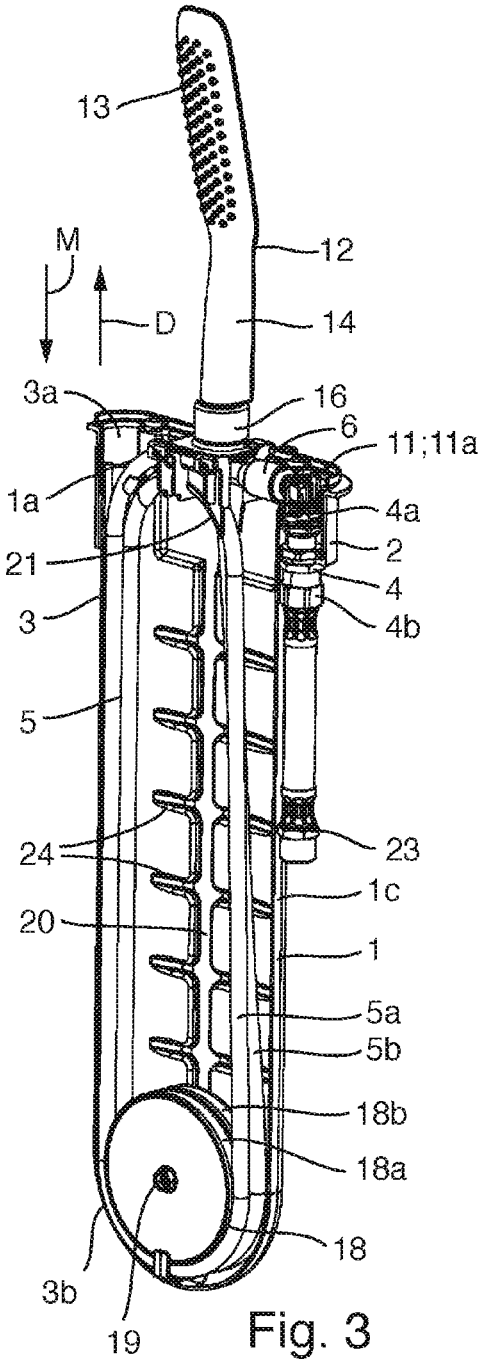
FIG. 3 shows a longitudinal section, in perspective, of the shower in FIG. 1 with the covering rosette removed.
Figure 4:
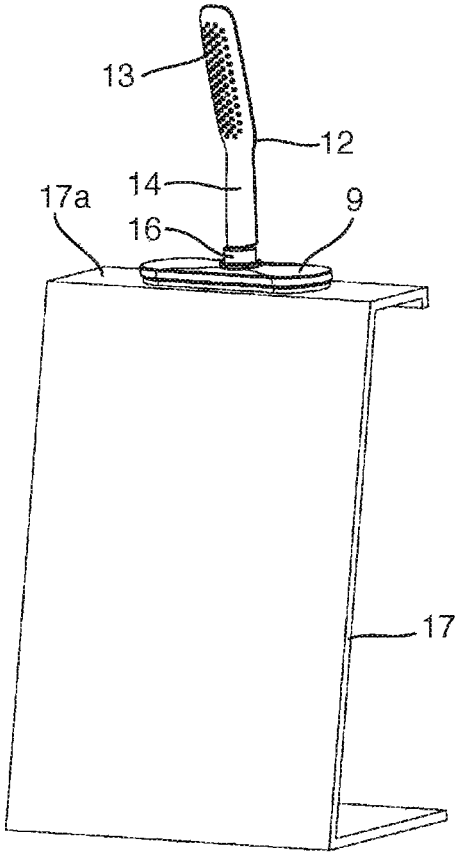
FIG. 4 shows a perspective view from the outside of a bathtub panel region with the shower shown in FIGS. 1 to 3 mounted thereon.

For easier removal of the box housing 3 from the box holding frame 2, a mounting bracket arrangement having at least one or, as shown, two mounting brackets 22 or, alternatively, more than two mounting brackets is optionally disposed on the open top side 3*a* of the box housing 3, said brackets being in a rest position in the assembled state of the pull-out hose device, e.g. being turned down parallel to the box top side 3*a*, for example, as can be seen from FIG. 2. To manipulate the box housing 3, i.e. to move it into the box holding frame 2 or remove it therefrom, the mounting brackets 22 can be turned up through about 90°, for example, into an operating position, as illustrated in FIGS. 10 and 11, for example.

In corresponding embodiments, the mounting bracket arrangement can include a releasable locking mechanism for attaching the box housing 3 to the box holding frame 2. For this purpose, the locking mechanism is configured and disposed in such a way, in a manner which is conventional per se, that it is released by the turning movement of the mounting bracket or brackets 22 from the rest position to the operating position and is locked by a turning movement of the mounting bracket or brackets 22 from the operating position to the rest position. To remove the box housing 3 from the box holding frame 2, the mounting brackets 22 must therefore first of all be turned up into the operating position.

Removing the box housing 3 from the box holding frame 2 in the demounting direction D simultaneously releases the fluid connector 4, i.e. the connection, in this example the plug connection, between the two connector pieces 7*a*, 7*b*. The second connector part 4*b* with the associated second connector piece 7*b* remains on the box holding frame 2, while the first connector part 4*a* with the first connector piece 7*a* is pulled off upwards. The non-return valve 10 prevents water from escaping, even if the second connector part 4*b* is coupled via its inlet connector piece 23 to a water supply and the latter is open. Such removal of the box housing 3 can be used, for example, to perform maintenance work on the pull-out hose 5 or the other components in the box housing 3 or on the second connector part 4*b*, which may then be more accessible, or to empty leaked fluid or leaked water that may have collected in the lower region 3*b* of the box housing 3 from said housing.

Figure 10:
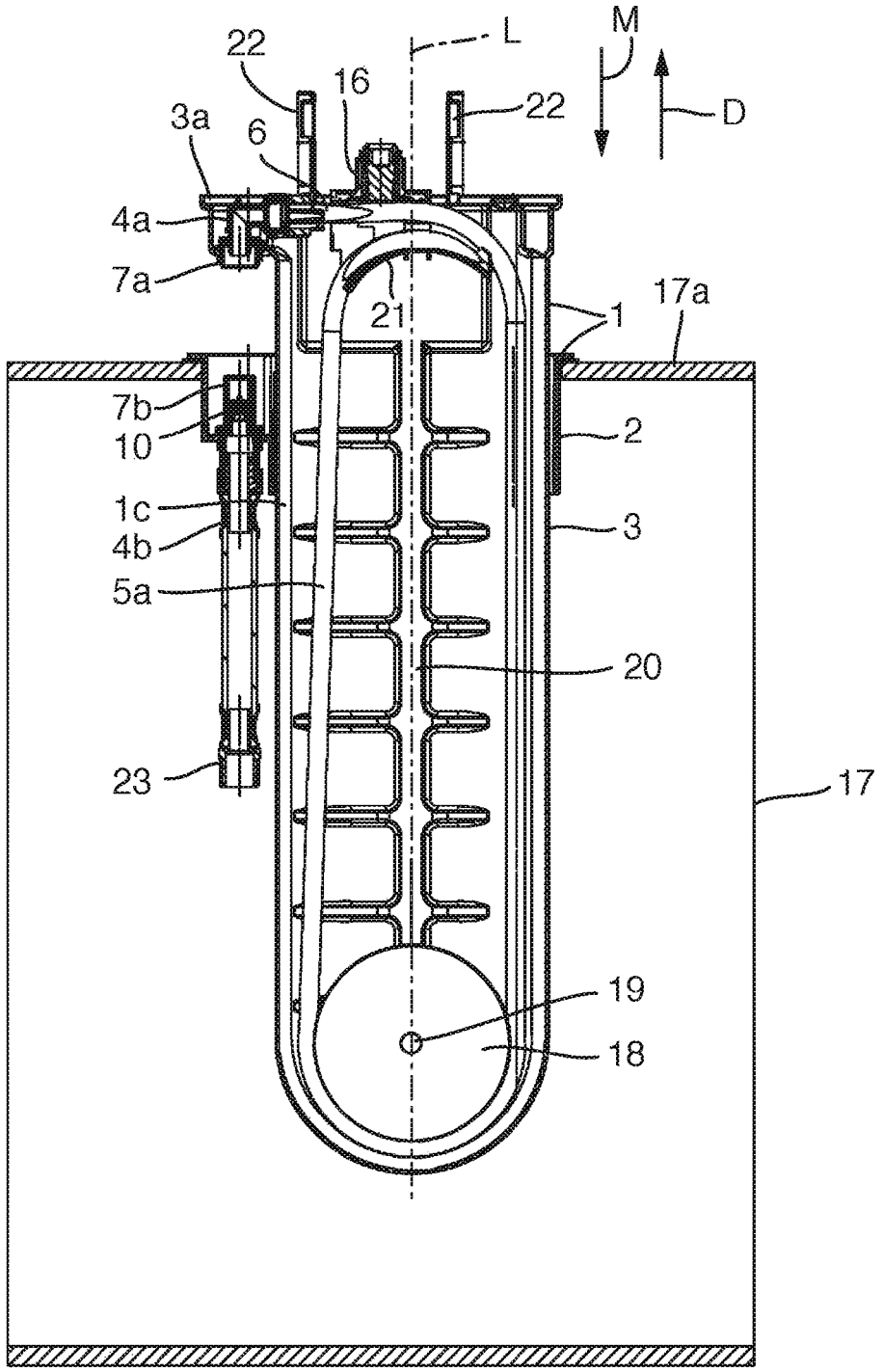
FIG. 10 shows a longitudinal section of the shower in the tub panel region of FIGS. 4 and 5 in a position with the box housing raised from a box holding frame.
Figure 11:
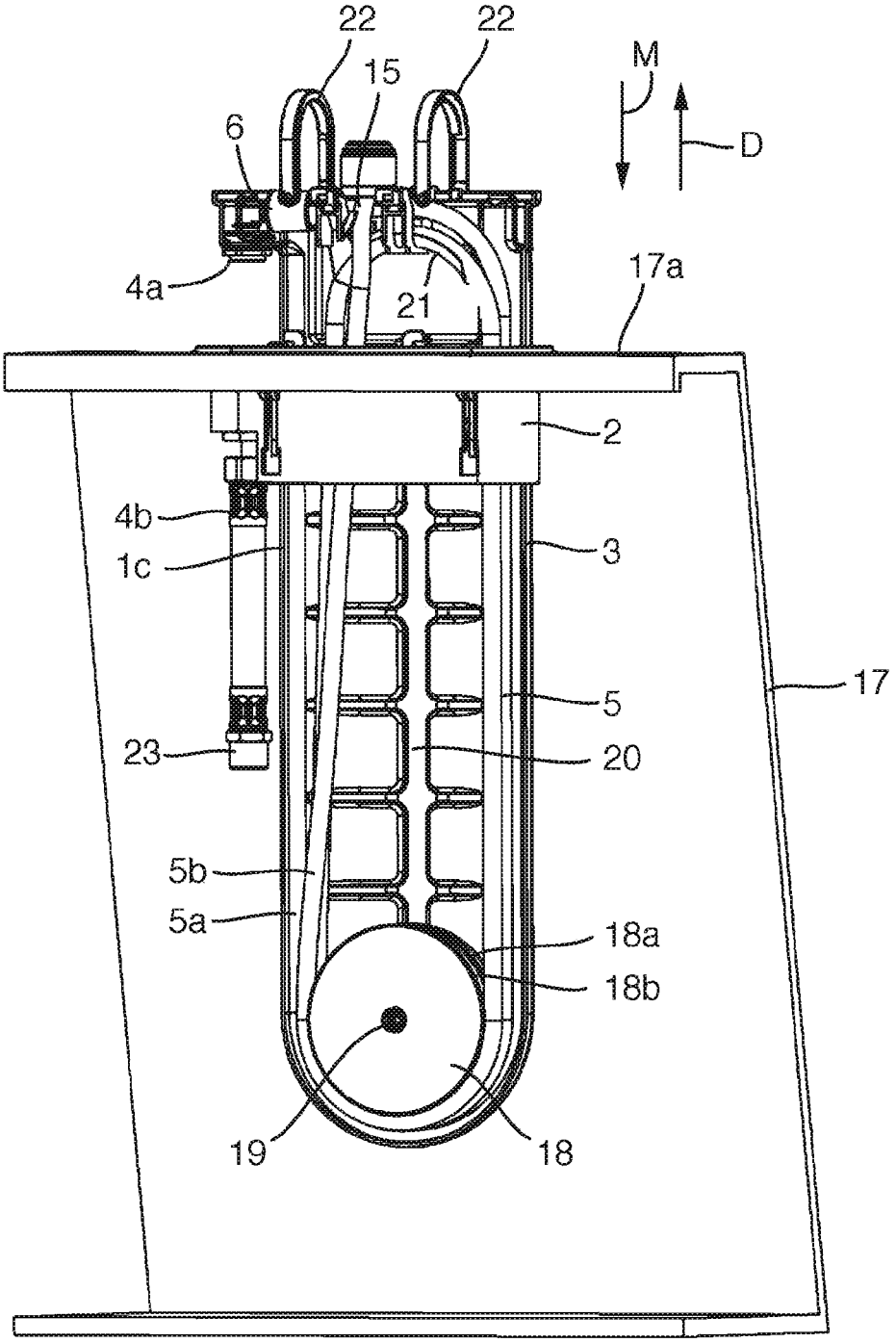
FIG. 11 shows a perspective section of the pull-out hose device on the tub panel region in the position according to FIG. 10.

FIGS. 10 and 11 illustrate the pull-out hose device in the state where the box housing 3 has been moved partially out of the box holding frame 2, wherein the fluid connection 4 has already been released or separated, i.e. the first connector piece 7*a* has already been moved completely out of its plug connection with the second connector piece 7*b*. The box housing can be reinserted into the box holding frame in the mounting direction M in a similar way, as a result of which the first connector piece 7*a* is simultaneously reconnected to the second connector piece 7*b*, and the fluid connector 4 is thus re-created.

It is self-evident that the shower shown and the pull-out hose device shown are not only suitable for hand-held shower devices for bathtubs but also, for example, for kitchen sink devices with a pull-out shower device and other devices for supplying fluid that have a pull-out hose. As the illustrative embodiments shown and explained above make clear, the invention makes available a pull-out hose device which, in a very advantageous manner, has a hose box housing which can be removed from a box holding frame and on which the pull-out hose is held to enable it to be pulled out, wherein the fluid connector for the pull-out hose can be created or released simultaneously with the mounting or demounting of the box housing.

Although the invention has been described in detailed with reference to preferred embodiments, variations and modifications exist within the spirit and scope of the invention as described and defined in the following claims.

The invention claimed is:

1. A pull-out hose device comprising:

a hose box with a box holding frame and a box housing which is removably attachable to the box holding frame in a mounting direction and is detachable from the box holding frame in a demounting direction;

a pull-out hose held on the box housing to be pulled out and having at least one hose bend accommodated in the box housing;

a fluid connector for the pull-out hose;

wherein the fluid connector includes a first connector part disposed on the box housing, the pull-out hose being connected to the first connector part by one hose end, and a second connector part disposed on the box holding frame; and wherein the first and the second connector parts are connectable to each other in a fluid-tight manner in the mounting direction and are disconnectable from each other in the demounting direction.

2. The pull-out hose device according to claim 1, wherein:
the first connector part has a first connector piece and the second connector part has a second connector piece;
the first and the second connector pieces are insertable into each other; and
the second connector piece extends into the interior of the box housing through an opening of the box housing in parallel to the mounting direction.

3. The pull-out hose device according to claim 1, wherein the mounting direction is a translational direction or a rotational direction, or a pivoting direction and the demounting direction is opposite to the mounting direction.

4. The pull-out hose device according to claim 1, wherein:
the box housing is open on a top side and is fluid-tight at least in a lower region; and
in an installed position of the hose box, the mounting direction extends vertically.

5. The pull-out hose device according to claim 1, wherein:
the at least one hose bend is accommodated in the box housing in variable length hanging downwards in a U-shape; and
the box housing is at least one of curved in a U-shape on its bottom side, and has a vertical length that is greater than its horizontal width.

6. The pull-out hose device according to claim 1, wherein
the box housing has a horizontal depth that is lesser than its horizontal width; and
the fluid connector is disposed in a narrow side region of the hose box.

7. The pull-out hose device according to claim 1, wherein the fluid connector is disposed in a top side region of the hose box.

8. The pull-out hose device according to claim 1, wherein the fluid connector includes a non-return valve to prevent backflow in a direction from the pull-out hose toward the second connector part.

9. The pull-out hose device according to claim 1, wherein the second connector part includes a non-return valve to prevent flow in a direction from the second connector part toward the pull-out hose.

10. The pull-out hose device according to claim 1, wherein the fluid connector includes a safety device to safeguard the first connector part against self-acting disengagement from the second connector part.

11. The pull-out hose device according to claim 1, wherein the box housing includes a mounting bracket arrangement with at least one mounting bracket that is turnable between an operating position and a rest position, which at least one mounting bracket includes a releasable locking mechanism, by means of which the releasable locking mechanism the attachment of the box housing to the box holding frame is capable to be locked, wherein the releasable locking mechanism is released by a turning move of the mounting bracket from the rest position to the operating position and is locked by a turning move of the mounting bracket from the operating position to the rest position.

12. A sanitary shower, comprising:
a pull-out hose device, including:
a hose box with a box holding frame and a box housing which is removably attachable to the box holding frame in a mounting direction and is detachable from the box holding frame in a demounting direction;
a pull-out hose held on the box housing to be pulled out and having at least one hose bend accommodated in the box housing;
a fluid connector for the pull-out hose;
wherein the fluid connector includes a first connector part disposed on the box housing, the pull-out hose being connected to the first connector part by one hose end, and a second connector part disposed on the box holding frame;
wherein the first and the second connector parts are connectable to each other in a fluid-tight manner in the mounting direction and are disconnectable from each other in the demounting direction;
a shower head unit having a shower outlet part and a shower handle part;
wherein the shower head unit is connected to a fluid outlet of the pull-out hose on a fluid inlet; and
wherein the hose box includes a holder for detachably holding the shower head unit.

* * * * *